United States Patent [19]

Meyer

[11] Patent Number: 4,644,603

[45] Date of Patent: Feb. 24, 1987

[54] PLUMBER'S SNAKE

[75] Inventor: Fred J. Meyer, North Miami Beach, Fla.

[73] Assignee: Eagle Industries, Inc., Hialeah, Fla.

[21] Appl. No.: 719,202

[22] Filed: Apr. 2, 1985

[51] Int. Cl.[4] ..... B08B 9/02

[52] U.S. Cl. ..... 15/104.3 SN

[58] Field of Search ..... 15/104.3 SN

[56] References Cited

U.S. PATENT DOCUMENTS

| | | | |
|---|---|---|---|
| 2,769,191 | 11/1956 | Hunt et al. | 15/104.3 SN |
| 3,283,353 | 11/1966 | Kirk | 15/104.3 SN |
| 3,574,878 | 4/1971 | Ardsley | 15/104.3 SN |
| 3,983,593 | 10/1976 | Naeve | 15/104.3 SN |

*Primary Examiner*—Edward L. Roberts

*Attorney, Agent, or Firm*—John Cyril Malloy

[57] ABSTRACT

A snake which can be power driven through a clutch or manually rotated with a crank. The coiled wire body terminates in a nose cylinder which has coils which are of a larger diameter, constant diameter, and expanded terminating in a cylinder snag tip cut-off co-extensive with the circumference of the expanded cylinder wire portions. A cap is provided over the sheath which surrounds the coiled wire at each end of the sheath, and having progressively smaller interior collar members terminating in a cap lip which permits the cap to snug-fittingly and progressively engage the end of the sheath, and yet permit it to be removed after usage so that the interior of the sheath can be flushed and when desired, filled with lubricating oil or another preservative. The method of the invention is directed to the utilization of a coiling head which coils the wire in a small diameter and then increases the diameter to form the nose cylinder. The nose cylinder is first formed in its compressed form at slightly more than its intended length. Thereafter the compressed cylinder is opened by applying tension at both ends to expose an expanded cylinder. Thereafter a cylinder cut-off portion or cylinder tail is removed and the operation progressively repeated.

2 Claims, 8 Drawing Figures

PLUMBER'S SNAKE

FIELD OF THE INVENTION

The present invention is directed to a plumber's snake or sewer or drain cleaning tool. It is of the type that has an elongate coiled wire body with a nose cone at the remote end, intended to be rotated as it is progressively inserted into a drain to dislodge any clogging or obstruction.

SUMMARY OF THE PRIOR ART

The prior art is exemplified by U.S. Pat. No. 3,283,353 entitled "Plumber's Snake Unit" and U.S. Pat. No. 3,574,878 entitled "Power Rooter With Safety Clutch." In both of these patents a general description of the operation of the snake is given. Basically the unit has a coiled wire body, a nose cone at one end, and a hand crank or power tool at the other end. The unit is inserted progressively into a drain such as clogged toilet, bathroom shower, sink, and the like. As it rotates the enlarged helical head in intended to either penetrate the clog, or hook onto the clog in order to withdraw the same. Invariably the power art auger heads are as shown in the two subject patents where it enlarges progressively from the coiled wire and then decreases in diameter to a very small end portion. The problem with this construction is that it does exactly the opposite of what is desired, namely, to snag large clogging pieces such as a disposable diaper, rag, etc. impale the same, and then permit the user to retrieve it rather than press it forwardly in the drain. This is particularly important where there may be a clog at a bend in the drain, and the snake cannot be compressively advanced due to the bend in the drain being anywhere from 10 to 20 feet away from where the power source is.

In addition the prior-art units have shown a sheath around the coiled wire and bearings at either end. This becomes highly undesirable since the plastic sheath itself is a good support and bearing surface, and is usually water lubricated. It further can reduce the power transmission by friction losses.

SUMMARY OF THE INVENTION

The present invention is directed to a snake which can be power driven through a clutch or manually rotated with a crank. The coiled wire body terminates in a nose cylinder which has coils which are of greater pitch, a larger diameter, constant diameter, and expanded terminating in a cylinder snag tip cut-off coextensive with the circumference of the expanded cylinder wire portions. A cap is provided over the sheath which surrounds the coiled wire at each end of the sheath, and having progressively smaller interior collar members terminating in a cap lip which permits the cap to snug-fittingly and progressively engage the end of the sheath, and yet permit it to be removed after usage so that the interior of the sheath can be flushed out when desired, and filled with lubricating oil or another preservative. The method of the invention is directed to the utilization of a coiling head which coils the wire in a small diameter and then increases the diameter to form the nose cylinder. The nose cylinder is first formed in its compressed form at slightly more than its intended length. Thereafter the compressed cylinder is opened by applying tension at both ends to expose an expanded cylinder. Thereafter a cylinder cut-off portion or cylinder tail is removed and the operation progressively repeated.

In view of the foregoing it is a principal object of the present invention to provide a snake with a nose cylinder having helical portions of substantially the same diameter and terminating in a snag tip cut-off which permits better penetration, greater torque, and an implaing action on clogs in drains.

Another object of the present invention is to provide a snake with sneath caps at each end of the sheath which do not frictionally engage the coiled wire, and are removable and replaceable for cleaning.

Yet another object of the present invention is to provide sheath caps for the sheath on a snake which will reduce the tendency for solids or foreign material other than drain water to enter the sheath and surround the coiled wire.

Still another object of the present invention is directed to the method of economically forming the nose cylinder of a snake in which a minimal amount of wire is sacrificed between progressive snakes being formed steadily from a coiling head.

But another object of the present invention is directed to providing a snake and method for forming it in which the costs are reduced from conventional units and yet the quality and effectiveness of the product is upgraded.

BRIEF DESCRIPTION OF THE DRAWINGS

Further objects and advantages of the present invention will become apparent as the following description of an illustrative embodiment proceeds, taken in conjunction with the accompanying drawings, in which.

DETAILED DESCRIPTION OF PREFERRED EMBODIMENTS

The Snake

Figure 1:
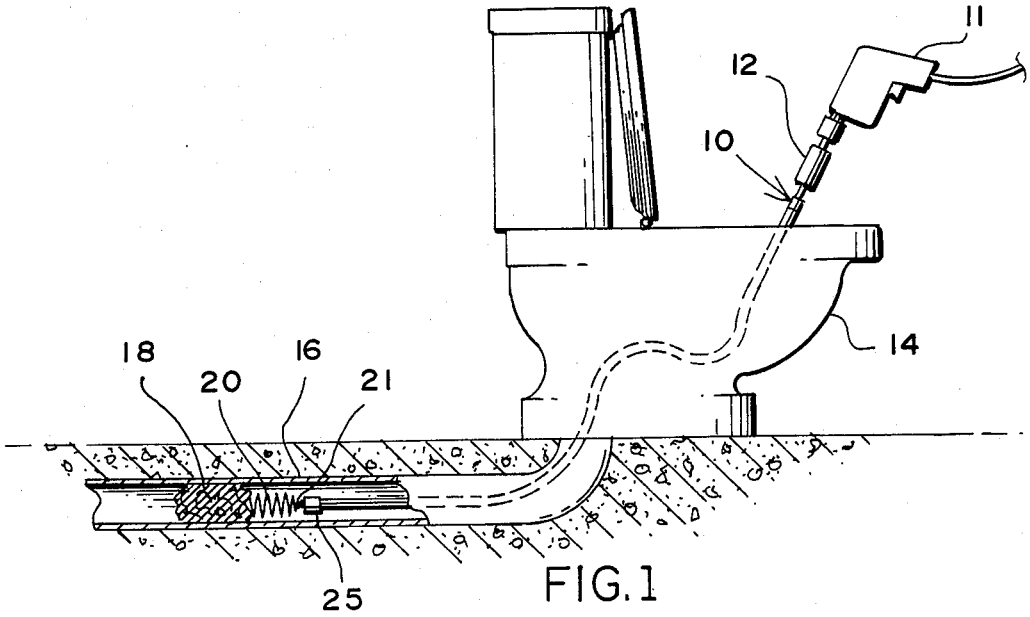
FIG. 1 is a partially diagrammatic view showing a snake with a power drill utilized in a toilet in order to dislodge a clog in a drain line.

Turning now to FIG. 1 it will be seen that the snake 10 is activated by a power drill 11 held by the user, and coupled to a clutch. The snake 10 is shown here cleaning a toilet by penetrating the drain 15 and passing into the drainpipe 16 where it engages a clog 18 which can be removed by pulling the snake out of the toilet 14, its drain 15, and sewer pipe 16.

Figure 2:
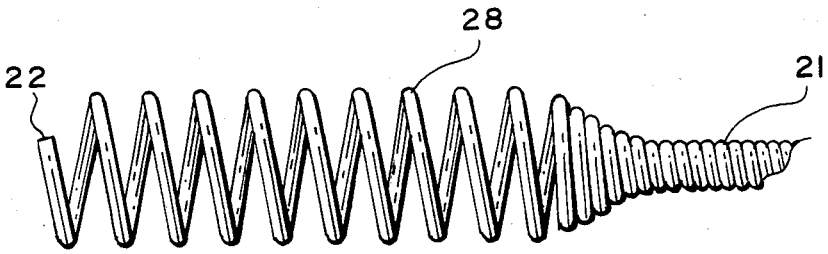
FIG. 2 is an enlarged view of the end of the snake showing the coiled wire and nose cylinder.

In FIG. 2 the operative end of the snake is shown as being a nose cylinder 20 which is activated by the coiled wire 21, and has a snag tip cut-off 22 which engages the clog 18 or other solids in the drainpipe 16 which are not wanted.

Figure 3:
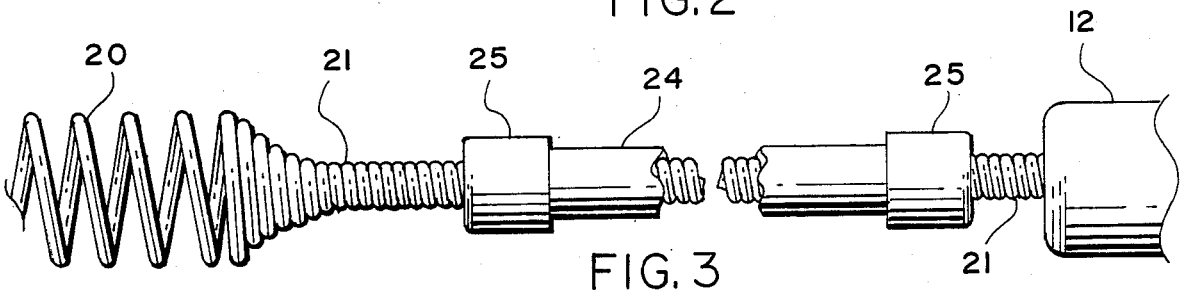
FIG. 3 is a sectioned exploded partially diagrammatic view showing the relationship between the sheath, coiled wire, sheath cap, and nose cylinder.

As seen in FIG. 3, a sheath 24 surrounds the coiled wire 21, and terminates in the nose cylinder 20 having the snag tip cut-off 22. A sheath cap 25 is provided at each end of the sheath 24.

Figure 4:
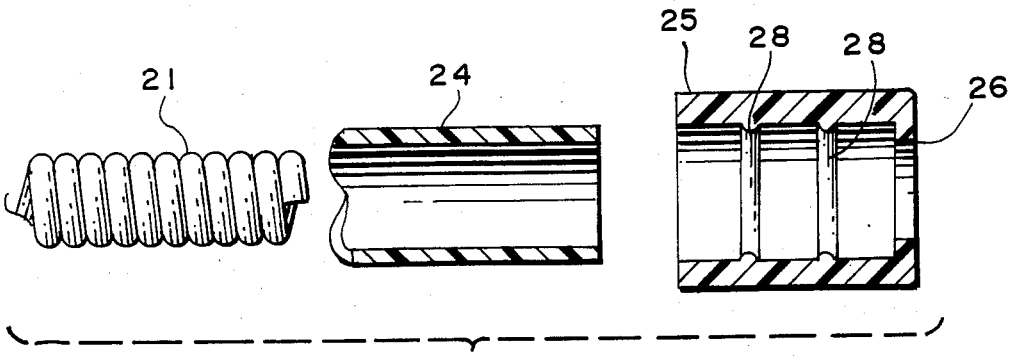
FIG. 4 is a further exploded view in enlarged scale showing the sheath cap and its interior collars and intended relationship with the sheath and coiled wire.
Figure 5:
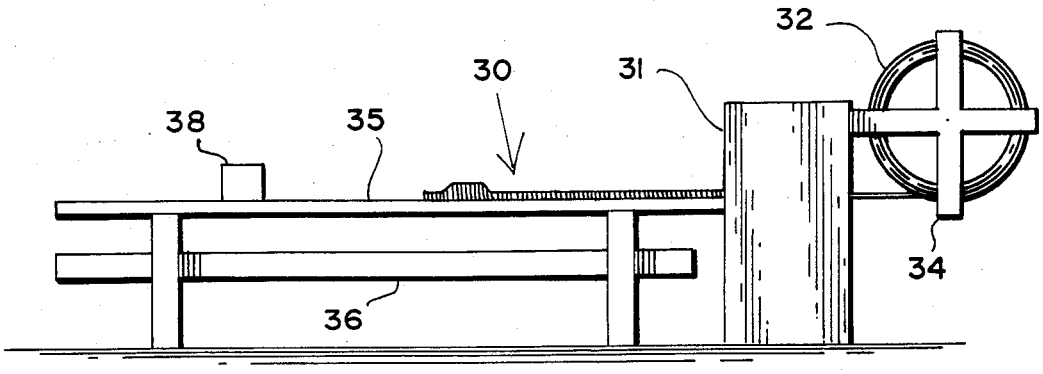
FIG. 5 is a partially diagrammatic view of a production line showing a coiling head, wire stock and reel, for forming the subject snake.

In greater detail as shown in FIG. 4, the sheath cap 25 terminates in a circular lip 26 which has a diameter sufficiently large to permit the coiled wire 21 to pass through the lip in a non-engaging fashion. Interiorly of the sheath cap 25 progressively smaller diameter collars 28 are formed. These permit a progressive compressive relationship with the end of the sheath 24 when the sheath cap 25 is placed on the sheath 24. Conversely, they permit the removal of the sheath cap 25 from the sheath 24 for cleaning or flushing after the work has been completed.

The Method

Figure 6:
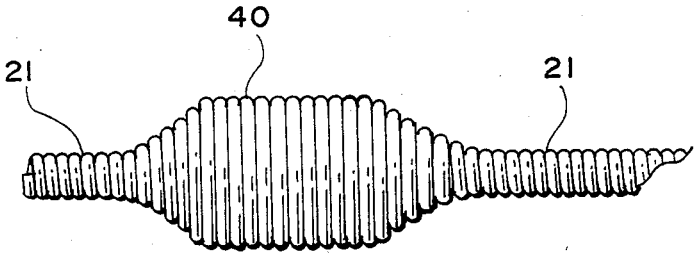
FIG. 6 is a view of one stage of the formation of the snake wherein the cylinder of enlarged diameter is in its delivered form from the coiling head in enlarged diameter, but compressed.
Figure 7:
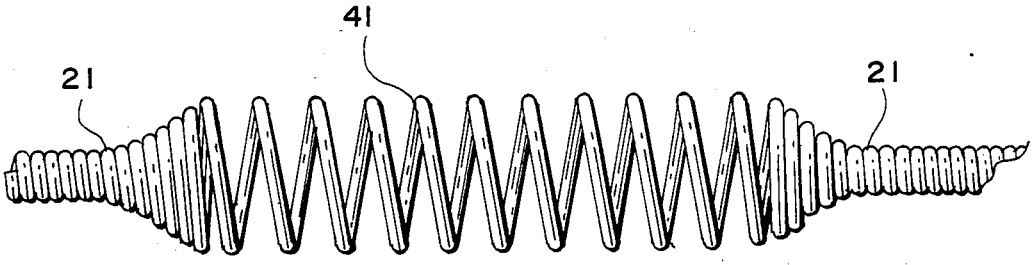
FIG. 7 is a sequential view from that shown in FIG. 6 wherein the cylinder is expanded by tugging at its two ends retaining its intended diameter, but opening up the space between the coils.
Figure 8:
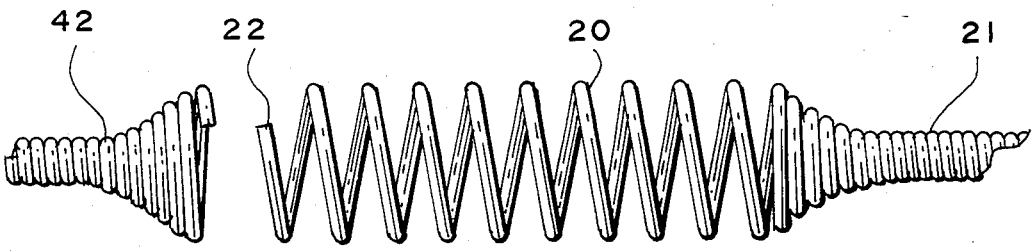
FIG. 8 is a final broken view showing how the cylinder is severed from the next member, and the cylinder tail cut off to permit the formation of a cylinder snag tip cut-off of substantially the same diametrical location as the balance of the expanded cylinder.

The method of the present invention in forming the snake 10 is illustrated in FIGS. 5–8. Initially in FIG. 5 it will be seen that a fabricating line 30 is provided which may be five to ten feet longer than the maximum length of the snake being formed. A coiling head 31 is fed by a wire stock 32 which is payed off a wire stock reel or carrier 34. A run-out tray is provided for the full length of the snake where the coiled wire 21 comes out of the coiling head 31. Immediately beneath the run-out tray 35 is a storage tray or a trough 36 into which individual ones of the snakes can be dumped for further processing. The cut-off activating switch 38 is provided at a remote end of the run-out tray 35 and stops the machine temporarily after the machine has formed a compressed enlarged cylinder 40 with the coiled wire 21 at either end. The coiled wire 21 at either end of the compressed cylinder is then put in tension to form an expanded cylinder as shown in FIG. 7. The compressed cylinder condition as it comes from the machine is shown in FIG. 6. The final step in fabrication of the wire portion is shown in FIG. 8 where the expanded cylinder 41 becomes the nose cylinder 20 as the cylinder snag tip cut-off 22 is made, and a further cut is made to remove the cylinder tail 42 from the adjacent coiled wire 21. Thereafter the cylinder tail 42 is discarded, and formed wire portions are dropped into the storage tray 36 for further processing.

In review it will be seen that a plumber's snake and method for forming the same have been described in detail which permits the utilization of pre-existing forming equipment to simply provide a nose cylinder of substantially constant diameter with a snag tip cut-off which firmly engages clogs and other foreign material within a drain. In addition the snake itself is provided, in the power version, with a sheath and sheath caps which can be removed for cleaning. In a manually driven version, the sheath may be omitted, and a hand crank provided at the location where the power drill is illustrated.

Although particular embodiments of the invention have been shown and described in full here, there is no intention to thereby limit the invention to the details of such embodiments. On the contrary, the intention is to cover all modifications, alternatives, embodiments, usages and equivalents of the subject invention as fall within the spirit and scope of the invention, specification, and the appended claims.

What is claimed is:

1. For use with a hand-operated driving means, a snake for cleaning a drain and the like, comprising, in combination:

(a) a driven member having an elongated configuration and defined by a generally cylindrical coiled wire of a first diameter, comprising wire coils in abutting relation to one another, (b) an integral nose cylinder on said coiled wire defining a distal end of said coiled wire and comprising a plurality of spaced apart coils each having a substantially equal diameter greater than said first diameter, and an integral generally cone-shaped zone comprising closely adjacent wire coils intermediate said nose cylinder and said coiled wire, (c) said nose cylinder terminating at a distal free extremity of said plurality of coils in a snag tip, (d) said snag tip being disposed substantially within the cylindrical path of the diameters of said nose cylinder, (e) a sheath structure having an elongated configuration and a hollow interior extending continuously along its length, said coiled wire movably disposed within said hollow interior of said sheath structure along a majority of the length of said coiled wire, (f) said sheath structure comprising a sheath cap secured to each end thereof, each sheath cap comprising a central aperture formed therein and dimensioned to allow passage of said coiled wire therethrough in non-frictional engagement therebetween, (g) each of said sheath caps further comprising a plurality of annularly configured collars mounted on an interior surfaces thereof and disposed in spaced relation to one another, each of said collars having an inner diameter of lesser dimension than said interior surface and further dimensioned to frictionally engage said sheath structure, each of said sheath caps gripping opposite ends of said sheath structure at a plurality of spaced locations along the length of said respective sheath cap.

2. In the snake of claim 1, said sheath cap terminating in a cap lip having a circular opening in its center of a diameter larger than the coiled wire.

* * * * *